United States Patent [19]

Jaffa

[11] Patent Number: 4,606,268

[45] Date of Patent: Aug. 19, 1986

[54] MULTI-STATION, MULTI-COLOR SCREEN PRINTING APPARATUS AND METHOD FOR USING SAME

[75] Inventor: David Jaffa, Franklin Lakes, N.J.

[73] Assignee: Precision Screen Machines, Inc., Hawthorne, N.J.

[21] Appl. No.: 175,228

[22] Filed: Aug. 4, 1980

[51] Int. Cl.[4] ..... B41F 15/04; B05C 17/06

[52] U.S. Cl. ..... 101/115; 101/126

[58] Field of Search ..... 101/123, 126, 115

[56] References Cited

U.S. PATENT DOCUMENTS

| | | | |
|---|---|---|---|
| 2,690,118 | 9/1954 | Schwartz | 101/123 X |
| 2,791,173 | 5/1957 | Livingood | 101/126 X |
| 3,427,964 | 2/1969 | Vasilantone | 101/126 X |
| 4,084,504 | 4/1978 | Fuchs | 101/126 X |

*Primary Examiner*—A. J. Heinz

*Attorney, Agent, or Firm*—Philip D. Amins

[57] ABSTRACT

In a multi-color, multi-station screen printer, a first assembly comprising a plurality of screens is mounted coaxially with a second assembly comprising a plurality of workpiece supporting pallets. In one embodiment, of the method of the present invention, where only a single operator is required, the plurality of pallets do not rotate but the plurality of screens are selectively displaced in unison and in one angular direction. In another embodiment of the method of the present invention, where three operators are utilized, the plurality of screens and the plurality of pallets rotate, each in unison, about a common, vertical axis in both angular directions. A combination of four screens and three pallets are described but other combinations are possible. Large and small articles may be printed in a single cycle.

23 Claims, 22 Drawing Figures

MULTI-STATION, MULTI-COLOR SCREEN PRINTING APPARATUS AND METHOD FOR USING SAME

BACKGROUND OF THE INVENTION

1. Field of the Invention

This invention relates generally to screen printing apparatus and more particularly to a multi-station, multi-color screen printer as well as a method for using this apparatus.

2. Description of the Prior Art

The prior art to which the present invention is directed teaches many different types of rotary screen printing devices. As used herein, the term rotary refers to angular displacement of the screens about a vertical axis when different workpieces are to be printed. The aforementioned prior art includes a four-color, one-station screen printer; a four-color, four-station screen printer: a six-color, one-station screen printer; and a six-color, six-station screen printer. All of the foregoing prior art screen printers have a common loading and unloading problem because of the positioning of the printing screens with respect to the printing stations. That is, the prior art structure requires that the operator lean into the machine to load and unload the articles to be printed at one or more of the printing stations. This represents a substantial element of danger since the printing stations are, by definition, rotatable about a vertical axis. Therefore, it is entirely possible for the apparatus to be rotating at the time that the operator is either loading or unloading the articles at a particular printing station. In addition to the inherent dangers in the prior art structures, there is also the inconvenience of reaching inwardly in order to load and unload the machine. These actions are both time consuming and tiring and, therefore, result in lower efficiency with an attendant increase in unit cost and decrease in quality.

SUMMARY OF THE INVENTION

In its broadest aspect, the present invention provides both a novel apparatus and a novel method directed to a multi-color, multi-station screen printer for articles such as T-shirts or the like. However, it should be appreciated from the following disclosure that the present invention is not limited to T-shirts. Other articles that may be retained on a pallet at a printing station can also be used.

The present invention provides a unique combination of the number of printing screens with respect to the number of printing stations and resembles the features of a six-station screen printer except that there are only four adjacently located printing screens and only three printing stations that cooperate therewith. The screens are spaced 60 degrees apart from each other and cover an arc of 180 degrees. The 180 degree remainder of the arc of the four printing screens is unused. The three printing stations however are spaced 120 degrees apart in one embodiment. In an alternative embodiment, it is possible to employ six printing stations that are 60 degrees apart from each other. In one embodiment both the printing screen assembly and the printing station assembly are rotatable about a common axis which, in the present invention, is vertical. In another embodiment, only the printing screen assembly is rotatable about the vertical axis. In both embodiments, the printing screen assemblies are pivoted about a horizontal plane when moving from the non-printing position to the printing position and back again.

The present invention is unique in that one printing station is always fully accessible for either loading or unloading of the articles to be printed. Because of this unique feature, the operator is able to safely and conveniently accomplish the tasks of inspecting, loading, unloading and smoothing out any wrinkles, if necessary. In addition, the present invention is not limited to the above described combination of four printing screens and three printing stations. Other combinations of printing screens and printing stations can be arranged in order to provide the unique features that constitute the essence of the present invention.

Accordingly, it is an object of the present invention to provide an improved multi-color, multi-station screen printer.

Another object of the present invention is to provide an improved multi-color, multi-station screen printer, as described above, having the production capacity of a six-color, six-station screen printer but with fewer screens and fewer stations.

Still another object of the present invention is to provide an improved multi-color, multi-station screen printer, as described above, wherein one station is always fully accessible for loading and unloading of the articles to be printed during the entire cycle of operation.

Yet another object of the present invention is to provide an improved multi-color, multi-station screen printer, as described above, that is inherently safe to operate and which does not require the operator to lean into the machine for either loading or unloading of the articles to be printed while any portion of the machine is rotating.

It is a more particular object of the present invention to provide an improved multi-color, multi-station screen printer, as hereinabove described, wherein two different size printing stations may be employed at the same time.

A further object of the present invention is to provide an improved multi-color, multi-station screen printer, as described above, utilizing four printing screens in combination with three printing stations.

Yet another object of the present invention is to provide an improved multi-color, multi-station screen printer, as described above, wherein the printing screens and the printing stations are both rotatable about a common vertical axis with the printing screens being rotatable in both angular directions.

BRIEF DESCRIPTION OF THE DRAWINGS

These and other objects, features and advantages of the present invention will become more apparent from the following detailed description considered in conjunction with the accompanying drawings, wherein.

DETAILED DESCRIPTION OF THE PREFERRED EMBODIMENT

Figure 1:
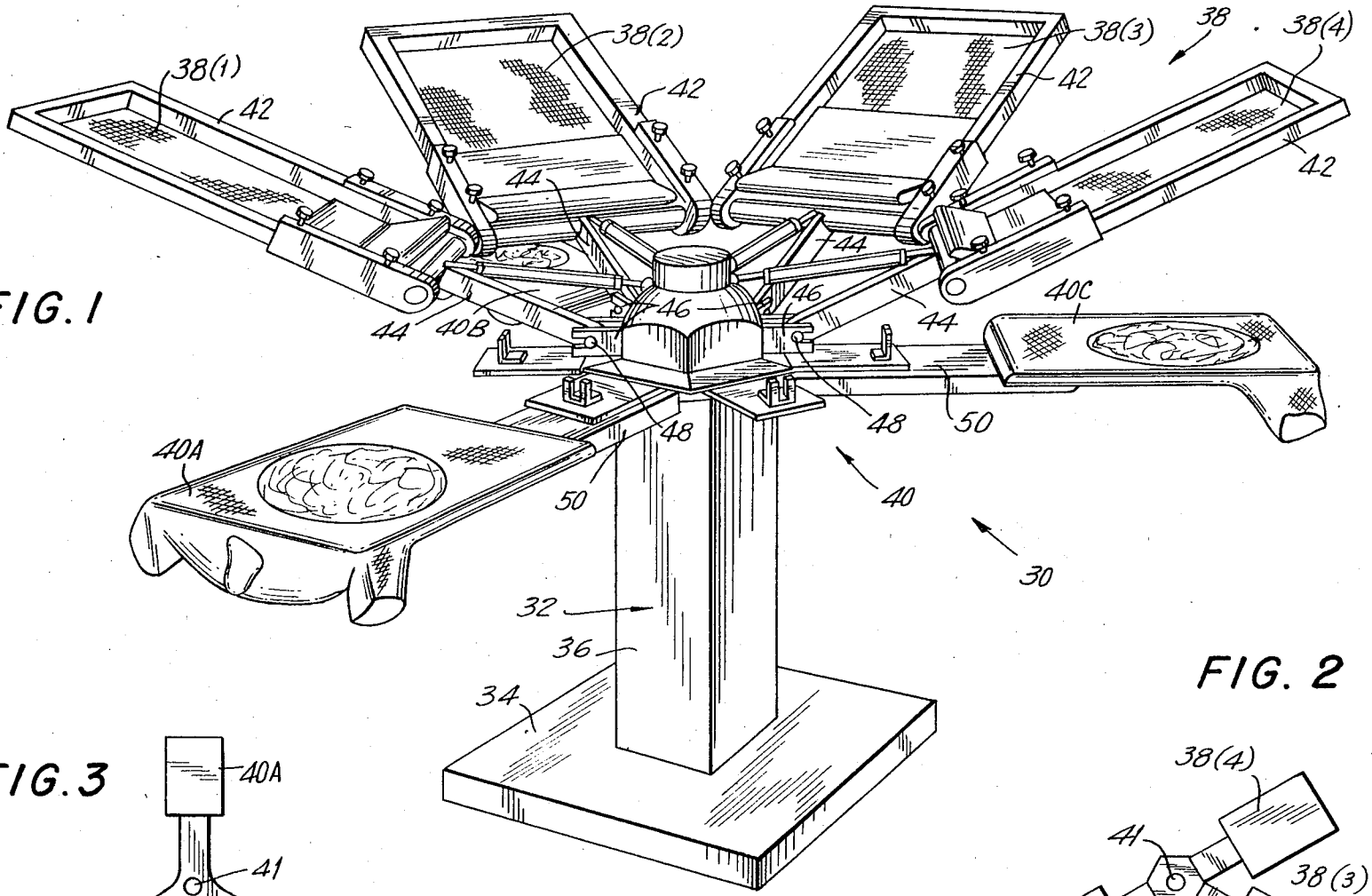
FIG. 1 is a perspective view illustrating one embodiment of the improved multi-color, multi-station printer comprising one embodiment of the present invention.

Referring now to FIG. 1, there is shown one structural embodiment of the improved multi-color, multi-station screen printer 30, comprising the present invention. The screen printer 30 includes a pedestal assembly 32 that is constituted by the combination of a base section 34 and a vertical column 36 extending upwardly from the base section 34. Although not specifically illustrated, it should be understood the column 36 is hollow.

A printing screen assembly generally designated by the reference numeral 38 and a printing station assembly generally designated by the reference numeral 40 are both mounted for rotation about a common, vertical axis 41 that extends along and is disposed within the column 36. Since the shafts and bearings that support the printing screen assembly 38 and the printing station assembly 40 are well known in the art, and since they do not form any part of the present invention per se, they are not illustrated.

The individual printing screen assemblies 38(1), 38(2), 38(3) and 38(4) as well as the individual printing station assemblies 40(A), 40(B) and 40(C) are also well known in the art and are not, per se, novel. It is their combination and arrangement as well as their mode of operation that constitutes the present invention.

Figure 2:
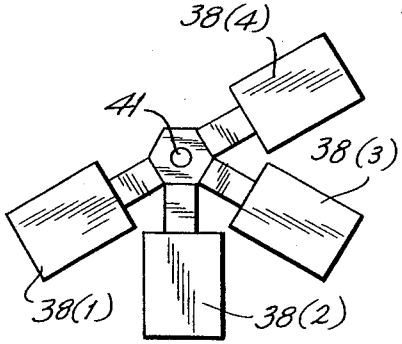
FIG. 2 is a plan view schematically illustrating only the printing screen assembly shown in FIG. 1.

The printing screen assemblies 38(1) through 38(4), as shown in FIGS. 1 and 2, each include a frame 42 which encloses and retains the printing screen in a conventional and well known manner. Each frame 42 is secured by any suitable means to a generally radially oriented arm 44 which is coupled to the screen assembly hub 45 by means of a slotted arm 46 that receives a transverse pivot pin 48. In this manner, each frame 42 may be pivoted upwardly and downwardly in unison about the horizontal axis of the pin 48 when moving between the printing and non-printing positions in addition to being rotatable about the vertical axis 48 of the column 36.

As best shown in FIG. 2, the printing screen assembly 38, which is constituted by the four frames 42, comprises four axes that are 60 degrees apart so that the four frames 42, in combination, cover an arc of 180 degrees. The remaining 180 degrees of the arc is unused.

The three printing stations 40(A)–40(C), in the first embodiment of this invention, are each coupled in any suitable manner to a respective arm 50 that extends radially from the column 36 (FIG. 1). As shown best in FIG. 3, the three printing stations 40(A)–40(C) are arranged 120 degrees apart from each other. It is also to be noted in FIG. 1 that a second set of arms 52 can be secured to the column 36 in order to provide for the support of three additional printing stations; which arrangement will be described subsequently in connection with an alternative embodiment of the present invention.

As discussed hereinbefore, the printing screen assembly 38 and the printing station assembly 40 are rotatable about the common axis 41 which extends within the column 36. In the alternative embodiment, the printing screen assembly 38 is rotatable in two angular directions and the printing station assembly is rotatable in one direction.

Bearings and other well known mounting arrangements for the assemblies 38 and 40 are employed but are not illustrated since they are conventional and are well known, and do not form part of the present invention.

Figure 3:
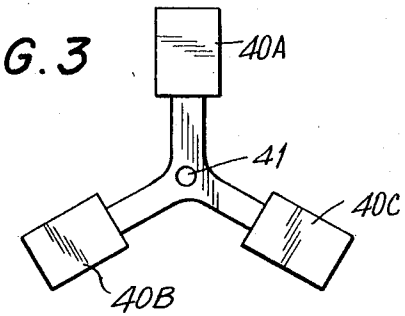
FIG. 3 is a plan view schematically illustrating only the rotatable printing station assembly shown in FIG. 1.

For the purpose of describing the first method of operation of the present invention, reference is now had to FIG. 2 and to FIG. 3 which schematically illustrate the printing screen assembly 38 and the printing station assembly 40, respectively. In order to simplify the ensuing description, the four screen frames 42 will be referred to only by reference numerals 1, 2, 3 and 4 and the three pallets that comprise the printing station assembly 40 will be designated only by the reference characters A, B and C. The operator required to perform the method comprising the first embodiment of the present invention is always considered to be accessible to the 8 o'clock and 12 o'clock positions for the purpose of this discussion. The printing screen assembly 38 of the first embodiment is arranged to rotate away from the pallet at the 12 o'clock position in the counterclockwise direction.

Referring now to FIG. 2, there is schematically shown the printing scree assembly 38 comprising the present invention which is constituted by four screens labeled 1, 2, 3 and 4. The four printing screens are spaced 60 degrees apart from each other and occupy an arc of 180 degrees with the remainder of the arc being unused. For purposes of explanation, the screen 1 is located 120 degrees in the counterclockwise direction away from the 12 o'clock position and, at the beginning of the cycle, is located directly over the pallet B.

Figure 4:
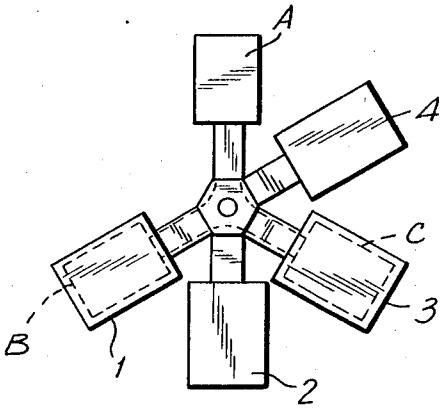
Figure 9:
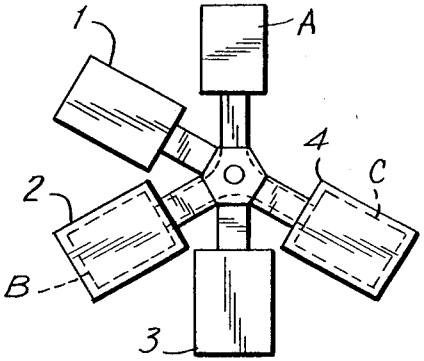
Figure 8:
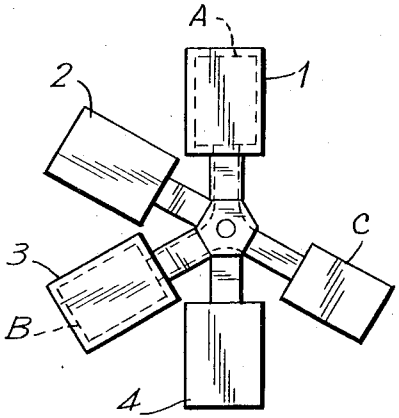

The first embodiment of the method comprising the present invention will now be described utilizing FIGS. 4–13. A first T-shirt is loaded on the pallet A, in any conventional manner, with the pallet A always being at the 12 o'clock position as shown in FIG. 4. With the assembly 40 of pallets A, B and C held stationary, the printing screen assembly 38 comprising screens 1, 2, 3 and 4 is rotated 60 degrees counterclockwise to the position shown in FIG. 5, so that the screen 4 is positioned over the pallet A and the screen 2 is positioned over the pallet C. Screens 3 and 1 are not positioned over any pallet and the pallet B is uncovered so that a second shirt can be loaded thereon at approximately the 8 o'clock position. The first shirt that is on pallet A has its first color printed thereon by screen 4 when the two assemblies 38 and 40 are in the relationship shown in FIG. 5.

Figure 6:
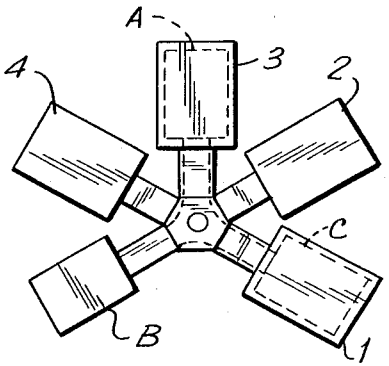
FIGS. 4–21 are schematic plan views illustrating the successive steps in one complete cycle of operation according to two different embodiments of the method comprising the present invention.
Figure 5:
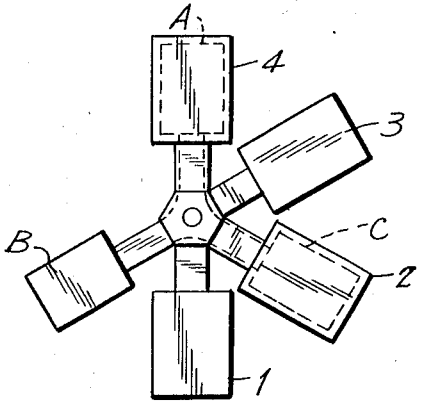

The assembly 38 of screens 1, 2, 3 and 4 is then rotated 60 degrees in the counterclockwise direction to the position shown in FIG. 6 so that the screen 3 is positioned over the pallet A and the screen 1 is positioned over the pallet C. There is no screen positioned over the pallet B which has not been moved. At this time the second color is printed by means of the screen 3 that is located over the first shirt which is on the pallet A. The second shirt that is on the pallet B does not have any color printed on it because there is no screen thereover and the pallet C is devoid of any shirt.

Figure 7:
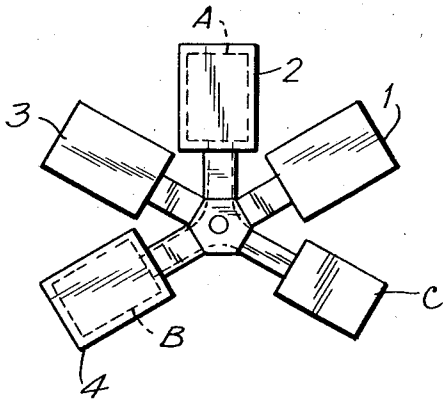

Once again, as shown in FIG. 7, the assembly 38 composed of the screens 1, 2, 3 and 4 is rotated 60 degrees in the counterclockwise direction and the third color is printed on the first shirt which is on the pallet A at the 12 o'clock position by means of the screen 2. At the same time, the shirt that was loaded second on the pallet B has its first color printed thereon by means of the screen 4. Once again the assembly 38 is rotated 60 degrees in the counterclockwise direction to the position shown in FIG. 8 in order to print the fourth color on the first shirt on the pallet A by means of the screen 1. Simultaneously, the second shirt which is on the pallet B has its second color printed thereon by means of the screen 3. The assembly 38 is then rotated 60 degrees once again in a counterclockwise direction to the position shown in FIG. 8 so that the first shirt which has already had four colors printed thereon may be unloaded from the pallet A at the 12 o'clock position. During the same step in the process the third color is printed on the second shirt on the pallet B by means of the screen 2. There is no shirt on pallet C so that screen 4 does not print.

Figure 11:
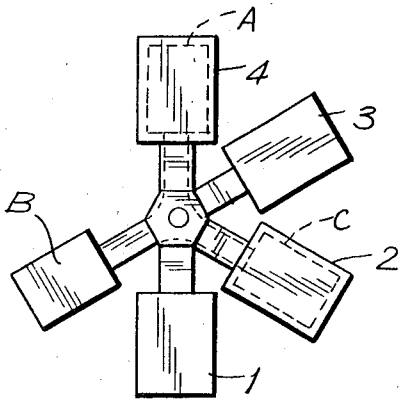
Figure 10:
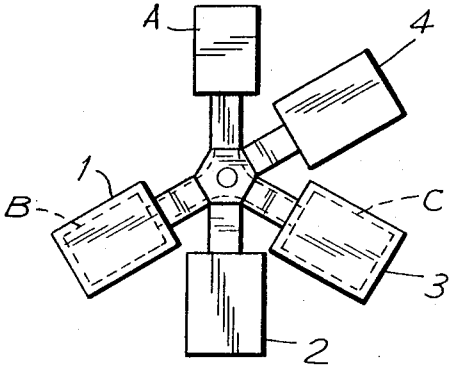
Figure 13:
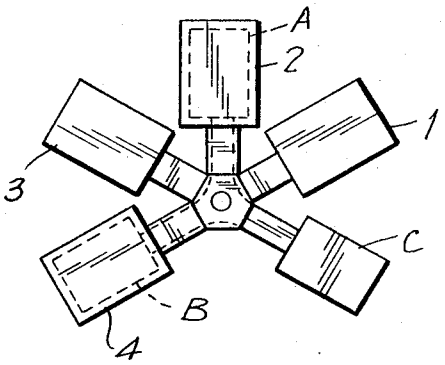

Referring now to FIG. 10, it will be seen that the assembly 38*i* has been rotated once again in a counterclockwise direction over an arc of 60 degrees. A third shirt may now be loaded on the pallet A and the fourth color will be printed on the second shirt that is on the pallet B by means of the screen 1. There is no shirt on pallet C so that screen 3 does not print. In FIG. 11 it will be seen that, after the screen assembly 38 has been rotated still another time in a 60 degree counterclockwise direction, the first color may be printed on the third shirt on pallet A by means of the screen 4 and, simultaneously, the second shirt that has already had four colors printed thereon may be unloaded from the pallet B. There is still no shirt on the pallet C so that the screen 2 does not print.

Figure 12:
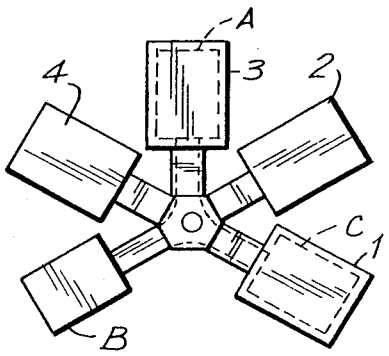

After the screen assembly 38 has been rotated again, over an arc of 60 degrees in a counterclockwise direction to the FIG. 12 position, the third shirt which is on the pallet A will have its second color printed thereon by means of the screen 3 while, at the same time, a fourth shirt is loaded on the pallet B. Further rotation of the assembly 38 over an arc of 60 degrees in a counterclockwise direction results in the arrangement shown in FIG. 13. At this time, the third color may be printed on the shirt on the pallet A by means of the screen 2 and the first color may be printed on the shirt on the pallet B by means of the screen 4. It will be readily apparent that the operation may be continued in the foregoing manner so that shirts are continuously loaded and unloaded and are sequentially printed.

The second embodiment of the method comprising the present invention will now be described in connection with FIGS. 14–21. In this embodiment there are three operators. The same structure is utilized but in this embodiment the assembly 38 constituted by the four screens 1, 2, 3 and 4 is angularly reciprocated while the assembly 40 comprising the three pallets A, B and C is rotated in only a single direction. As in the previous embodiment, the four printing screens 1, 2, 3 and 4 are spaced 60 degrees apart and occupy an arc of 180 degrees with the remaining portion of the arc being unused. Similarly there are three pallets A, B and C that are located 120 degrees apart. The three operators are positioned adjacent the three pallets A, B and C.

Figure 15:
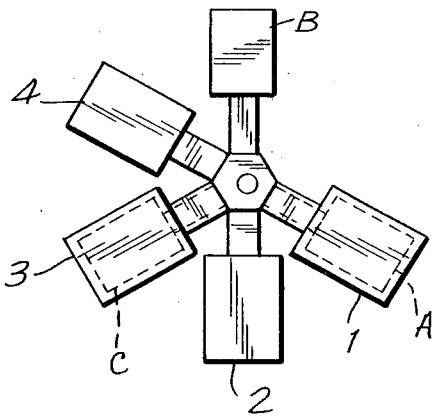
Figure 14:
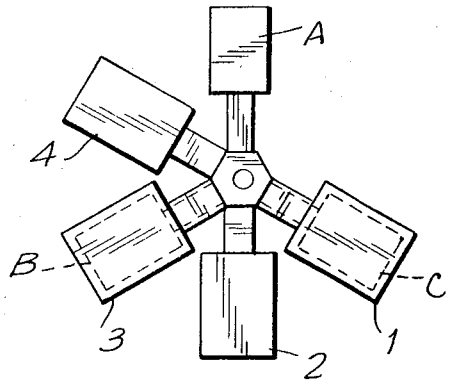
Figure 16:
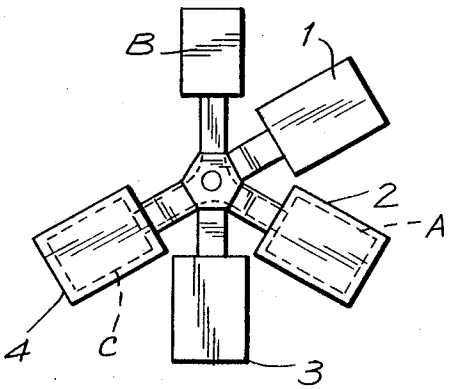

As the first step in the method of the second embodiment of this invention, the first shirt is loaded on the pallet A when the pallet A is oriented with respect to the four screens 1, 2, 3 and 4, as shown in FIG. 14. The operators adjacent the pallets B and C do nothing at this time. The assembly 40 comprising the three pallets A, B and C is then rotated 120 degrees in the clockwise direction so that the pallet B is at 12 o'clock position, the pallet A is under the screen 1 and the pallet C is under the screen 3. This is shown in FIG. 15. It should be noted that the assembly 38 comprising the four screens 1, 2, 3 and 4 has not been rotated as yet. The printing operation starts with the first color being printed on the first shirt on the pallet A by the screen 1. There is no shirt on the pallet C so that screen 3 does not print at this time. A second shirt is then loaded on the pallet B at the 12 o'clock position. The assembly 38 of the screens 1, 2, 3 and 4 is then rotated 60 degrees in the counterclockwise direction so that the pallet B remains uncovered at the 12 o'clock position and a second color is printed on the first shirt on the pallet A by the screen 2. This arrangement is shown in FIG. 16. There is still no shirt on the pallet C so that the screen 4 does not print.

For the first time in this second embodiment both assemblies 38 and 40 are rotated. That is, the assembly 38 comprising the screens 1, 2, 3 and 4 is rotated 60 degrees in the clockwise direction and the assembly 40 comprising the pallets A, B and C is rotated 120 degrees in the counterclockwise direction to assume the relationship shown in FIG. 17. At this time, the third color may be printed on the first shirt that is on the pallet B that is under screen 3, the first color may be printed on the second shirt that is on the pallet C that is under the screen 1 and the third shirt is loaded on the pallet A at the 12 o'clock position.

Figure 18:
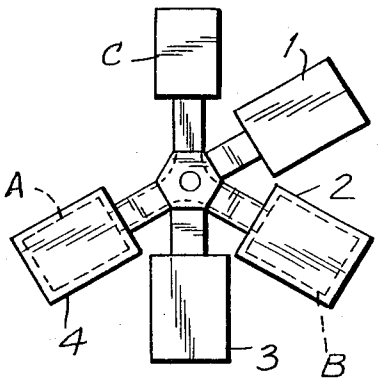
Figure 17:
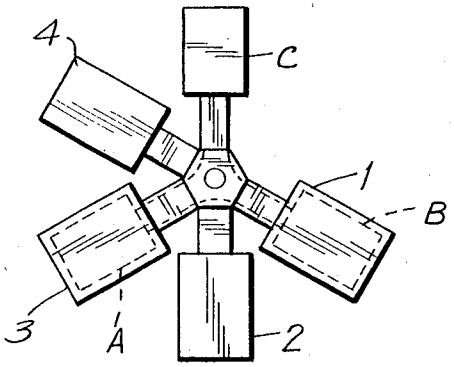
Figure 19:
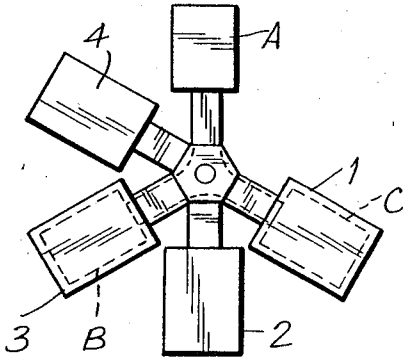

Turning now to FIG. 18, it will be seen that the assembly 38 comprising the four screens 1, 2, 3 and 4 has been rotated 60 degrees in the counterclockwise direction so that the fourth color may be printed on the first shirt on the pallet B by means of the screen 4 while the second color is printed on the second shirt on the pallet C by means of the screen 2. As the next step in the method of this embodiment, and as shown in FIG. 19, the screen assembly 38 is rotated 60 degrees in the clockwise direction to bring the unprinted third shirt under the screen 1. The assembly 40 is rotated 120 degrees, also in the clockwise direction and at the same time, to bring the fully printed first shirt to the 12 o'clock position and the second shirt under the screen 3 on the pallet B. The fully printed first shirt is then removed from the pallet A. At the same time, the first color is printed on the third shirt on the pallet C under the screen 1 and the third color is printed on the second shirt on the pallet B under the screen 3.

Figure 21:
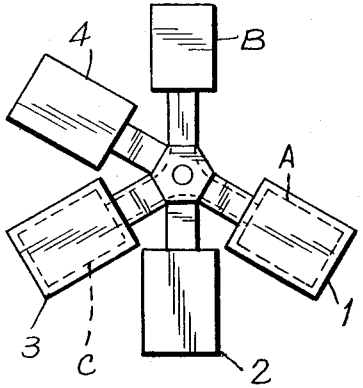
Figure 20:
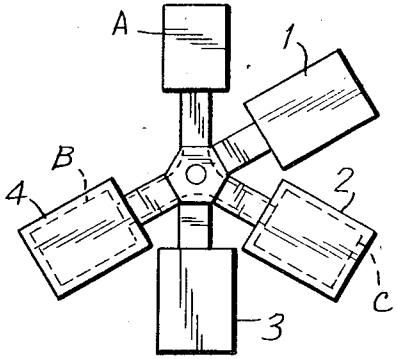

With the assembly 40 being oriented such as shown in FIG. 19, the fourth unprinted shirt is put on pallet A at the 12 o'clock position. The screen assembly 38 is then rotated 60 degrees in the counterclockwise direction to the position shown in FIG. 20 (without moving the assembly 40) after which the fourth color is printed on the second shirt disposed on the pallet B under the screen 4 while at the same time the second color is printed on the third shirt on the pallet C that is under the screen 2. Finally, as the last step in the method comprising the second embodiment of this invention and as illustrated in FIG. 21, the assembly 40 is rotated 120 degrees in the clockwise direction and the assembly 38 is rotated 60 degrees in the clockwise direction. The fully printed second shirt may then be removed from the pallet B at the 12 o'clock position. At the same time, the fourth shirt on the pallet A has its first color printed thereon by the screen 1 and the third shirt on the pallet C has its third color printed thereon by the screen 3. This effectively completes a full cycle of the second embodiment of the method of this invention.

Figure 22:
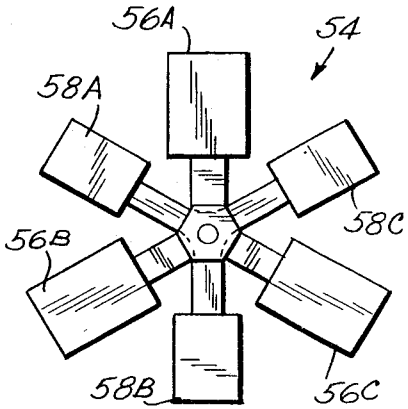
FIG. 22 is a schematic plan view illustrating an alternative embodiment of the multi-color, multi-station screen printer comprising the structure of the present invention.

Still another embodiment of the present invention is illustrated by FIG. 22. Therein it will be seen that an alternative pallet assembly 54 is provided comprising a first set of pallets 56(A) through 56(C) which are spaced 120 degrees apart and a second set of pallets 58(A) through 58(C) which are also spaced 120 degrees apart and which alternate with the individual pallets in the first set 56. The second of the pallets 58 are relatively small as compared to the first set of pallets 56. Thus, relatively large shirts would be placed on the first set of pallets 56 and relatively small shirts would be placed on the second set of pallets 58. In the third embodiment illustrated by FIG. 22, if the screens in the assembly 38 are of sufficiently small size, then all that need be done is to move the assembly 54 into a position where one of the second set of pallets 58 is at the 12 o'clock position. The assembly 54 is then locked into position and the sequence of steps described in connection with the first method comprising the first embodiment of this invention is carried out. It should be noted that while it is possible to print both large and small shirts, such as adult and juvenile shirts simultaneously, the sequence and operations are deemed to be sufficiently complex so as to render such an operation as impractical.

While I have shown and disclosed several of the embodiments of the present invention, it will be apparent to those skilled in the art that various changes, modifications and improvements may be made hereto without departing from the spirit and scope of the invention.

I claim:

1. Apparatus for printing a plurality of colors on a workpiece, said apparatus comprising:

a plurality of workpiece supporting pallets mounted radially a given distance from a vertical axis and spaced apart from each other by 120 degrees, a plurality of printing screens mounted radially about the vertical axis and rotatable in unison about the vertical axis, relative to said pallets, said screens being equally spaced apart from each other by 60 degrees along an arc of less than 360 degrees, and said screens being positioned at the same distance radially as said pallets.

2. The apparatus according to claim 1, comprising at least two of said pallets, and including four of said screens arranged along an arc of 180 degrees.

3. The apparatus according to claim 1, wherein said screens are individually pivotable about a horizontal axis.

4. The apparatus according to claim 1, wherein said pallets are rotatable in unison about the same vertical axis as said screens.

5. The apparatus according to claim 4, wherein said screens are rotatable in two angularly opposite directions.

6. The apparatus according to claim 4, wherein said pallets are rotatable in two angularly opposite directions.

7. The apparatus according to claim 1, including two different sized sets of said plurality of pallets for supporting workpieces of different sizes.

8. The apparatus according to claim 7, including means for unitarily supporting all of said pallets, and means for selectively locking said supporting means to prevent the rotation thereof.

9. The apparatus according to claim 1, wherein said plurality of workpieces and said plurality of screens are mounted on concentric shafts.

10. The apparatus according to claim 9, wherein said concentric shafts are contained within a pedestal.

11. A method of printing a plurality of different colors on a workpiece utilizing a plurality of different printing screens that are supported as a single, rotatable unit with respect to a workpiece supporting means in the form of a plurality of pallets, said method comprising the steps of:

loading a first workpiece on a first one of the pallets, rotating the screens as a unit to thereby place a first screen in operative relationship with the first workpiece whereby a first color is printed thereon, loading a second workpiece on a second pallet, rotating the screens as a unit a second time and printing a second color on the first workpiece, rotating the screens as a unit a third time and printing a third color on the first workpiece and a first color on the second workpiece, rotating the screens as a unit a fourth time and printing a fourth color on the first workpiece and a second color on the second workpiece, rotating the screens as a unit a fifth time and printing a third color on the second workpiece, unloading the fully printed first workpiece, rotating the screens as unit a sixth time and printing a fourth color on the second workpiece, loading a third workpiece on the first one of the pallets, rotating the screens as a unit a seventh time and printing a first color on the third workpiece, unloading the fully printed second workpiece, rotating the screens as a unit an eighth time and printing a second color on the third workpiece, and loading a fourth workpiece on the second one of the pallets.

12. The method according to claim 11, including the step of loading the second workpiece concurrently with said step of printing the first color on the first workpiece.

13. The method according to claim 11, wherein said step of unloading the first workpiece is concurrent with said step of printing the third color on the second workpiece.

14. The method according to claim 11, wherein said step of loading the third workpiece is concurrent with the step of printing the fourth color on the second workpiece.

15. The method according to claim 11, wherein said step of unloading the second workpiece is concurrent with said step of printing the first color on the third workpiece.

16. The method according to claim 11, wherein said step of loading the fourth workpiece is concurrent with said step of printing the second color on the third workpiece.

17. The method according to claim 11, wherein there are four equally spaced apart screens covering an arc of 180 degrees, wherein there are two pallets spaced-apart 120 degrees, and wherein said rotating steps comprise displacing the screens as a unit over an arc of 60 degrees.

18. A method for printing a plurality of different colors on a workpiece utilizing a plurality of different printing screens that are supported as a single, rotatable unit with respect to a workpiece supporting means in the form of a plurality of pallets that are rotatable as a single unit, said method comprising the steps of loading a first workpiece on a first one of the pallets, rotating the pallets as a unit over an arc of 120 degrees in a first pallet direction, printing the first color on the first workpiece and loading a second workpiece on a second one of the pallets, rotating the screens as a unit over an arc of 60 degrees in a first screen direction and printing a second color on the first workpiece, rotating the screens as a unit over an arc of 60 degrees in a second screen direction, rotating the pallets as a unit over an arc of 120 degrees in a second pallet direction, printing the third color on the first workpiece, printing the first color on the second workpiece and loading the third workpiece on the third pallet, rotating the screens as a unit over an arc of 60 degrees in the first screen direction, printing the fourth color on the first workpiece and printing the second color on the second workpiece, rotating the screens as a unit over an arc of 60 degrees in the second screen direction, rotating the pallets as a unit over an arc of 120 degrees in the first pallet direction and unloading the first fully printed workpiece from the first pallet and loading an unprinted fourth workpiece on the first pallet, printing the first color on the third workpiece and printing the third color on the second workpiece, rotating the screens as a unit over an arc of 60 degrees in the first screen direction, printing the fourth color on the second workpiece and printing the second color on the third workpiece, rotating the pallets as a unit over an arc of 120 degrees in the first pallet direction, rotating the screens over an arc of 60 degrees in the second screen direction, unloading the fully printed second workpiece, printing the third color on the third workpiece, printing the first color on the fourth workpiece, and rotating the screens as a unit over an arc of 60 degrees in the first screen direction and printing the fourth color on the third workpiece and printing the second color on the fourth workpiece.

19. A multi-station, multi-color screen printing apparatus comprising:

a support having a given axis, a plurality of pallets each for supporting a workpiece mounted in a first plane radially about the axis of said support a given distance from said axis and spaced circumferentially 120° apart, a plurality of printing screens mounted radially for rotation in a second plane about said axis, said second plane being spaced from said first plane;

means to rotate said screens in unison about said support thereby bringing a screen and a pallet into overlying relationship for printing a color on the workpiece on the pallet; and, said screens being positioned a distance equal to that of said pallets from said axis and being spaced 60° apart.

20. A multi-station, multi-color screen printing apparatus as claimed in claim 19 in which the printing screens are each connected to the support by an arm.

21. A multi-station, multi-color screen printing apparatus as claimed in claim 20 in which each of the arms are pivotally connected to the support to permit the screens to be moved out of the plane of rotation.

22. A multi-station, multi-color screen printing apparatus as claimed in claims 19, 20 or 21, in which the screens are positioned along an arc which is less than 360°.

23. A multi-station, multi-color screen printing apparatus as claimed in claim 19, 20 or 21, comprising at least two pallets and four screens positioned along a semi-circular arc.

* * * * *